US007597521B2

(12) United States Patent
Wastel

(10) Patent No.: US 7,597,521 B2
(45) Date of Patent: Oct. 6, 2009

(54) QUADRUPLE VEHICLE PARKING SYSTEM

(75) Inventor: Andreas Wastel, Randolph, NJ (US)

(73) Assignee: Park Plus Inc., Oakland, NJ (US)

( * ) Notice: Subject to any disclaimer, the term of this patent is extended or adjusted under 35 U.S.C. 154(b) by 0 days.

(21) Appl. No.: 11/906,373

(22) Filed: Oct. 2, 2007

(65) Prior Publication Data

US 2009/0087290 A1 Apr. 2, 2009

(51) Int. Cl.
*E04H 6/06* (2006.01)

(52) U.S. Cl. ..... 414/240; 414/254

(58) Field of Classification Search ..... 414/228, 414/256, 255, 254, 264, 227, 239; 211/207, 211/208, 209
See application file for complete search history.

(56) References Cited

U.S. PATENT DOCUMENTS 4,209,276 A * 6/1980 Rosen ..... 414/240
4,674,938 A * 6/1987 Van Stokes et al. ..... 414/228
4,772,172 A 9/1988 Rosen
4,867,627 A * 9/1989 Tseng ..... 414/249
5,035,562 A * 7/1991 Rosen ..... 414/240
5,145,304 A * 9/1992 Rosen ..... 414/228
5,207,333 A * 5/1993 Peng ..... 211/85.8
5,622,466 A * 4/1997 Rossato ..... 414/228
6,106,210 A * 8/2000 Toxer ..... 414/234
6,241,049 B1 * 6/2001 Gooch ..... 187/285
6,652,205 B2 * 11/2003 Christensen ..... 410/100
7,061,197 B1 * 6/2006 Mullet et al. ..... 318/466
2004/0258506 A1 * 12/2004 Haag ..... 414/227

* cited by examiner

*Primary Examiner*—Charles A Fox
(74) *Attorney, Agent, or Firm*—Anthony J. Casella; Gerald E. Hespos

(57) ABSTRACT

A quadruple parking system configured to store at least four vehicles is provided. The vehicle parking system includes a rigid frame including four vertically upstanding posts, the frame generally defining a rectangular volume; at least three platforms movably disposed in the frame, each platform being configured to support at least one vehicle; the at least three platforms being coupled to each other by a telescopic coupling, wherein in a first position the at least three platforms are nested upon each other and, upon being elevated, each platform raises the platform below each other; and a hoist unit coupled to the telescopic coupling and configured to raise and lower the at least three platforms, wherein upon being fully raised the at least three platforms define four parking positions. The hoist unit employs an electric drive unit for ensuring consistent and smooth operation in various temperature conditions.

7 Claims, 6 Drawing Sheets

QUADRUPLE VEHICLE PARKING SYSTEM

BACKGROUND

1. Field

The present disclosure relates generally to vehicular parking systems, and more particularly, to a quadruple vehicle parking system for vertically parking at least four vehicles in the footprint of one vehicle including an electric actuation apparatus to ensure consistent and safe operation.

2. Description of the Related Art

Urban areas throughout the world continue to experience growth and a corresponding increase in vehicular traffic. The demand for office, commercial and residential space in urban areas often makes it economically impractical to maintain at-grade vehicular parking lots. In particular, owners of real estate often can make substantially more profit by developing their land with an appropriate building than they can by using the land as a parking lot. The construction of a building on the site of a former parking lot depletes the supply of at-grade parking spaces, and simultaneously increases the demand for such spaces in proportion to the traffic generated by the new building. Multilevel vehicular parking garages exist in most urban areas. However, structures of this type are expensive to build and operate.

Parking problems also exist for new or used car dealers and for operators of vehicular fleets. These businesses must have a parking capacity to meet their inventory or fleet needs. The costs associated with maintaining a large at-grade parking facility or a multi-level parking garage often will significantly erode the profits of such businesses.

Double-decked parking apparatuses have been available in the prior art. In particular, the prior art parking apparatus includes a platform onto which a vehicle may be driven. The apparatus further includes means for lifting the platform with the vehicle thereon a sufficient distance to enable a second car to be driven under the platform. Thus, the prior art parking apparatus enables two vehicles to be parked in an area approximately the size of a single parking space, and thereby approximately doubles the usage and efficiency of a parking area.

One very effective prior art parking apparatus is shown in U.S. Pat. No. 4,209,276 which issued on Jun. 24, 1980 and is commonly assigned to the owner of the present disclosure. The apparatus shown in U.S. Pat. No. 4,209,276 includes a generally horizontal platform that is disposed between a pair of upstanding stanchions. The platform can be selectively raised or lowered relative to the stanchions. The parking apparatus shown in U.S. Pat. No. 4,209,276 includes a pair of cylinders extending upwardly from the top of the stanchions, and pistons extending from the cylinders into engagement with the platform. The pistons are extended from the cylinders to lower the platform and are retracted into the cylinders to raise the platform. Although the parking apparatus of U.S. Pat. No. 4,209,276 is extremely effective, the apparatus defines a height substantially equal to the height of the stanchions plus the height of the cylinders. This overall height typically is 11 feet 4 inches and invariably is higher than the roof of a vehicle disposed on the elevated platform. The overall height of the apparatus shown in U.S. Pat. No. 4,209,276 often prevents using the apparatus in indoor parking facilities.

U.S. Pat. No. 4,772,172 also is commonly assigned to the owner of the present disclosure herein and shows an improvement to the earlier U.S. Pat. No. 4,209,276. The apparatus shown in U.S. Pat. No. 4,772,172 includes a parking platform that is disposed between a pair of substantially vertical stanchions and that can be raised and lowered relative to those stanchions. Stabilizer bar assemblies are provided on each side of the parking platform. Each stabilizer bar assembly includes a rocker arm pivotably connected to the platform and a control arm pivotably connected to a base. The rocker arm and the control arm are further pivotably connected to one another. Thus, the stabilizer bar assembly effectively folds upon itself as the parking platform is lowered and expands as the parking platform is raised. A piston and cylinder assembly is pivotably connected to each stanchion and to the rocker arm. Movement of the piston in one direction causes the rocker arm to fold toward the control arm and thereby lowers the parking platform. Movement of the piston in the opposed direction causes the rocker arm to rotate away from the control arm, and elevates the parking platform. The apparatus shown in U.S. Pat. No. 4,772,172 achieves the desirable objective of combining the lifting and stabilizing functions of the parking apparatus, thereby substantially improving the stabilization of the apparatus. In this regard, it must be emphasized that stability is an extremely important requirement for a parking apparatus, since the apparatus must efficiently raise and lower a vehicle and steadily hold the vehicle in an elevated condition for hours on end. Furthermore, the weight and center of gravity of vehicles vary considerably, thereby making stability of the apparatus even more important. The maximum height of the apparatus shown in U.S. Pat. No. 4,772,172 generally will be defined by the roof of the vehicle parked on the platform, and typically will be between 9.5 and 10.0 feet. This is a significant improvement over the apparatus in U.S. Pat. No. 4,209,276 which defined a total height of 11 feet 4 inches. In view of this difference, the parking apparatus of U.S. Pat. No. 4,772,172 can be used in many indoor locations that were not available to its predecessor, as well as all outdoor parking lots.

The disclosures of U.S. Pat. Nos. 4,209,276 and 4,772,172 are incorporated herein by reference.

The above described prior art vehicular parking apparatus has achieved significant commercial acceptance and is available in urban areas throughout the world. However, even further parking efficiencies would be desirable. In this regard, a tri-level parking apparatus could offer such further efficiencies in the use of the limited land available for vehicular parking. More particularly, a tri-level parking apparatus could mean a fifty percent increase in revenues to the operator of a parking facility as compared to the above described prior art double-decked parking apparatus. Similarly, a tri-level parking apparatus can yield much more efficient use of space to car dealers and owners of vehicular fleets. However, stability becomes an even more important design consideration for tri-level parking apparatus.

One prior art tri-level parking apparatus is shown in U.S. Pat. No. 4,674,938 which issued to Van Stokes et al. on Jun. 23, 1987. The apparatus, shown in U.S. Pat. No. 4,674,938 includes a large cumbersome frame having a complex arrangement of pulleys and straps that are intended to maintain stability as they lift the platforms from their lower positions to their respective elevated positions. In operation, upper and lower parking platforms shown in U.S. Pat. No. 4,674,938 are disposed in their respective lowermost positions and a vehicle is driven onto the upper platform. The upper platform is then lifted to a first elevated position which enables a vehicle to be driven onto the lower platform. The upper platform is raised again to a second elevated position. A strap extending between the upper and lower platforms causes the lower platform to be raised into the first elevated position as the upper platform is raised into the second elevated position. Thus, the movement of the upper platform from the first to the second elevated positions effectively pulls the lower platform upwardly. A third vehicle can then be driven under the lower parking platform.

Furthermore, all of the above-identified parking systems employ hydraulic systems to provide power to a lifting mechanism to raise and lower the vehicle platforms. However, hydraulic systems have several drawbacks. For example, the hydraulic fluid used in the system needs to be at an appropriate temperature for the system to work properly. This may cause delays in operation of the parking system and will affect performance of the system in cold weather seasons and in generally colder climates. Additionally, pump systems required for the hydraulic system will generate a large volume of noise during operation. Further, hydraulic systems are not environmentally friendly. There is potential for fluid leakage into the ground supporting the parking system and spent or use hydraulic fluid must be disposed of in an environmentally safe way.

In view of the above, there is a need for a vehicular parking apparatus which increases the parking capacity of prior art parking systems and requires only approximately the space previously afforded to a single vehicle footprint. There is a further need for multi-level parking systems that avoid complex structures such arrangements of pulleys and straps while providing an extremely stable parking apparatus. Furthermore, there is a need for multi-level parking systems that do not require hydraulic systems and are environmentally friendly.

SUMMARY

A quadruple parking system configured to store at least four vehicles is provided.

According to one aspect of the present disclosure, a vehicle parking system includes a rigid frame including four vertically upstanding posts, the frame generally defining a rectangular volume; at least three platforms movably disposed in the frame, each platform being configured to support at least one vehicle; the at least three platforms being coupled to each other by a telescopic coupling, wherein in a first position the at least three platforms are nested upon each other and, upon being elevated, each platform raises the platform below each other; and a hoist unit coupled to the telescopic coupling and configured to raise and lower the at least three platforms, wherein upon being fully raised the at least three platforms define four parking positions.

In another aspect, the hoist unit further includes an electric drive unit.

In a further aspect, the hoist unit includes a selectively rotatable drum coupled to the telescopic coupling configured for raising and lowering the telescopic coupling. In one embodiment, the drum further includes a ratchet mechanism configured to prevent lowering of the at least three platforms.

According to yet another aspect of the present disclosure, the hoist unit includes a selectively rotatable drum including at least one wire wound upon the drum coupled to the telescopic coupling, wherein rotation of the drum will raise and lower the telescopic coupling. In one embodiment, the telescopic coupling includes four sets of telescoping pipes and rods, each set being associated with one of the four vertically upstanding posts, and the hoist unit includes four wires wound upon the drum, each of the four wires coupled to one set of telescoping pipes and rods, wherein rotation of the drum will raise and lower the telescopic coupling. Optionally, the hoist unit further includes a bottom out mechanism configured to determine slack in the at least one wire and prevent rotation of the drum when slack is present.

In a further aspect, the vehicle parking system further includes a high limit switch positioned on at least one of the four posts at a maximum height of a highest one of the at least three platforms and configured to stop the hoist unit when the highest one of the at least three platforms make contact with the high limit switch. Optionally, a redundant high limit switch is disposed on at least one of the four posts other than the post including the at least one high limit switch.

In another aspect, the system further includes a detector configured for detecting if a vehicle is present on a lower most parking position of the frame, wherein the detector is further configured to stop the hoist unit upon detecting a vehicle.

According to a further aspect of the present disclosure, a vehicle parking system includes a rigid frame including four vertically upstanding posts, the frame generally defining a rectangular volume; at least three platforms movably disposed in the frame, each platform being configured to support at least one vehicle; the at least three platforms being coupled to each other by a coupling means, wherein in a first position the at least three platforms are nested upon each other and, upon being elevated, each platform raises the platform below each other; and an elevating means coupled to coupling means to raise and lower the at least three platforms, wherein upon being fully raised the at least three platforms define four parking positions.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION

Figure 1:
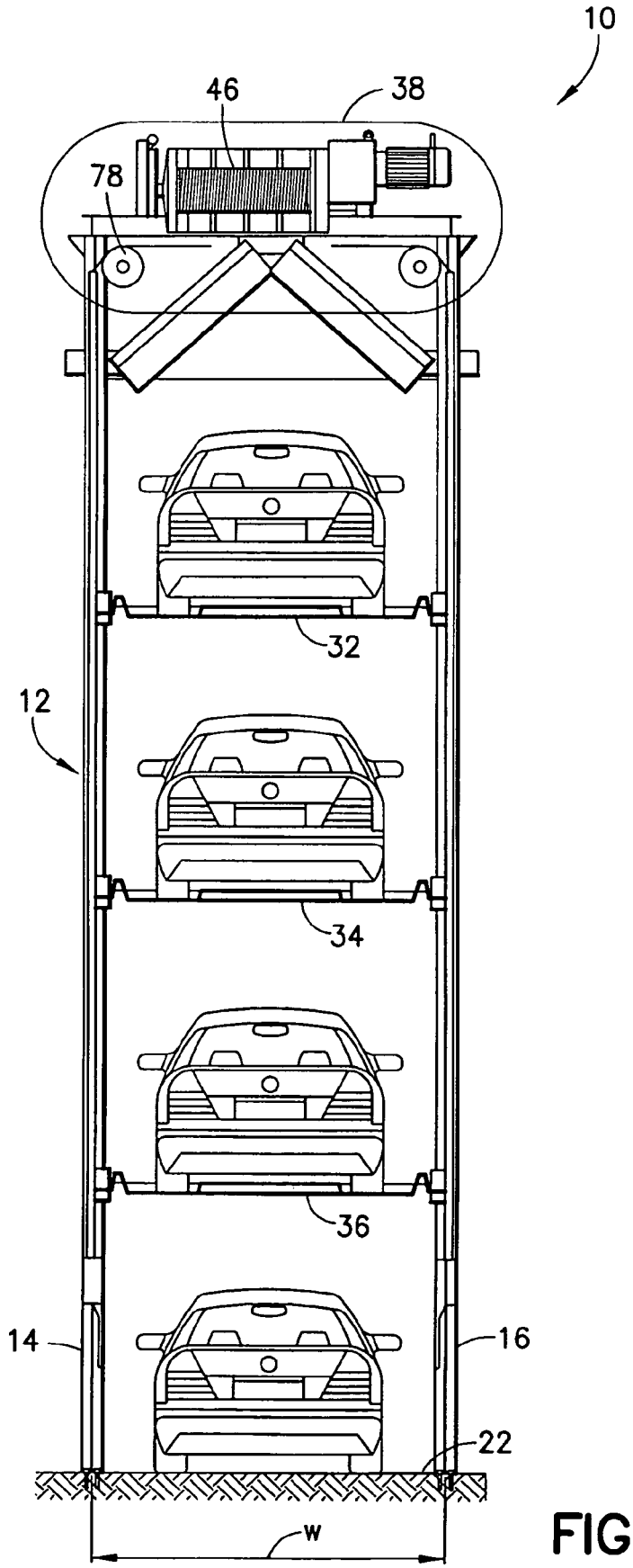
FIG. 1 is a front elevation view of a quadruple vehicle parking system supporting four vehicles in accordance with an embodiment of the present disclosure.

Preferred embodiments of the present disclosure will be described hereinbelow with reference to the accompanying drawings. In the following description, well-known functions or constructions are not described in detail to avoid obscuring the present disclosure in unnecessary detail.

A vehicle parking system of the present disclosure is identified generally by the numeral 10 in FIGS. 1-8. The parking system 10 includes a rigid frame 12 configured from four posts 14, 16, 18, 20 extending vertically from a base 22. Preferably, the posts, 14, 16, 18, 20 are formed from I-beams having a channel formed along both sides of the beam's longitudinal axis. The base 22 may be a preformed base, such as a concrete slab, or may be a surface of a floor housing the parking system 10. At an end of the four posts opposite the end coupled to the base, the four posts 14, 16, 18, 20 are rigidly fixed by front and back cross members 24, 26 and two side members 28, 30 which can be most clearly seen in FIG. 6. The four posts, cross and side members form the frame 12 to define a generally rectangular volume in which four vehicles will be disposed for parking purposes as will be described below. The four posts preferably define a height h1 of the frame of about 31 feet 5 inches. Post 14 and 16 and posts 18 and 20 are spaced apart in one direction to define a width w of the frame 12 of about 8 feet 3 inches to about 8 feet 6 inches and posts 14 and 18 and posts 16 and 20 are spaced, apart to define a length l of about 13 feet.

Figure 6:
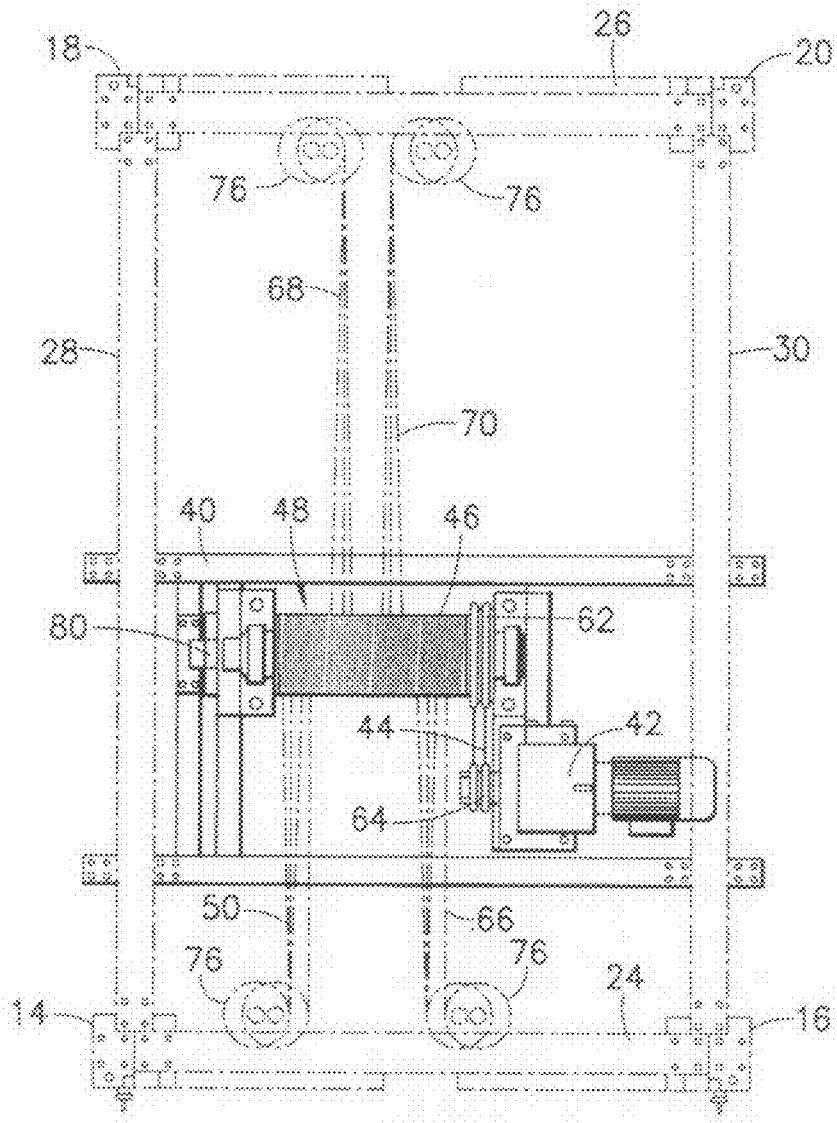
FIG. 6 is a top view of the vehicle parking system showing details of the hoist unit.

The vehicle parking system 10 includes first, second and third parking platforms 32,34,36 respectively. Each parking platform is dimension and configured to be nested over another lower parking platform when the platforms are in their lowermost position relative to the frame 12. The first, second and third platforms 32, 34,36 are positioned within the rigid frame 12 by a hoist unit 38 and system of telescopic rods and pipes. As best shown in FIG. 6, the hoist unit 38 is mounted to the top of the rigid frame 12 via a hoist frame 40 coupled to the side members 28, 30. The hoist unit 38 includes an electric drive unit 42 coupled via a chain 44 to a drum 46. Disposed about the drum 46 are a series of four separate wire lengths 48. Each length of wire is routed to one of the four posts 14,16,18,20. At each post, the wire is coupled to a series of telescopic rods and pipes configured to raise and lower the parking platforms 32,34,36.

Figure 4:
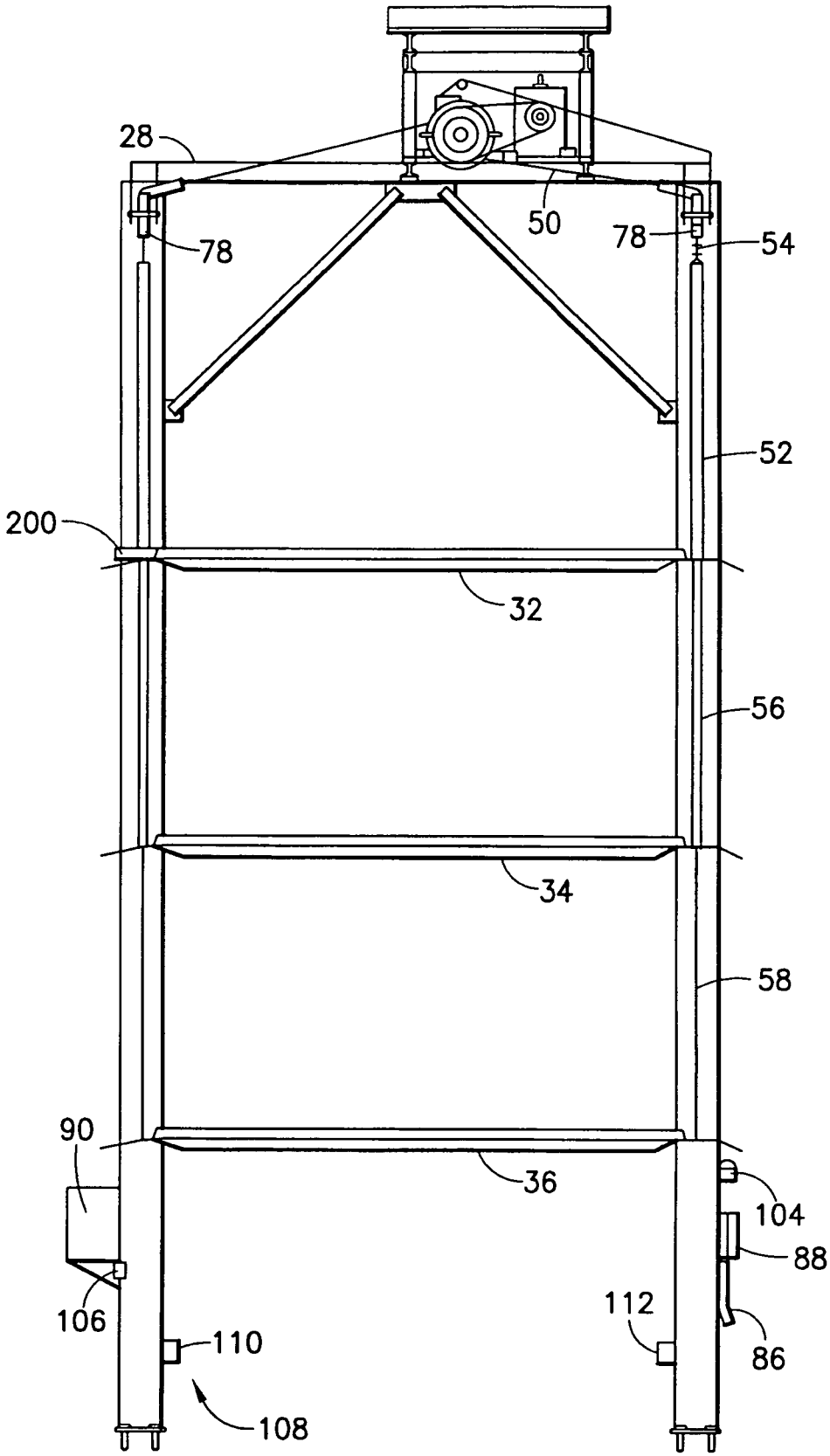
FIG. 4, is a side elevation view of the quadruple vehicle parking system shown in FIG. 3.

Referring to FIG. 4, the series of telescopic rods and pipes will be described in relation to one of the four posts. As described above, each post is formed from an I-beam having a channel along both sides of its longitudinal axis. Each series of telescopic rods and pipes is disposed in a channel of a respective post. Preferably, the series of telescopic rods and pipes are disposed in a channel facing the interior of the frame 12. It is to be appreciated that series of telescopic rods and pipes function identically at all of the posts. One of the four lengths of wire 50 is coupled to a first telescopic pipe 52 via a coupling means 54 such as a bolt or any other means known in the art. The lower portion of the first telescopic pipe 52 is coupled to the first parking platform 32. The first telescopic pipe 52 is dimensioned and configured to slide over second telescopic pipe 56. A lower portion of the second telescopic pipe 56 is coupled to the second parking platform 34. The second telescopic pipe 56 is dimensioned and configured to slide over third telescopic rod 58. A lower portion of the third telescopic rod 58 is coupled to the third parking platform 36.

Generally, in operation, the parking system 10 will initially have no vehicles disposed therein and the parking platforms 32,34,36 will be nested over each other at the base 22 of the frame 12. When activated, the drive unit 42 will rotate the drum 46 causing the wires 48 to be wound on the drum 46. As the drum is wound, the wires 48 will cause the first telescopic pipe 52 to be elevated in turn raising the first parking platform 32. As the lower end of the first telescopic pipe 52 reaches a top portion of the second telescopic pipe 56, the lower end of the first telescopic pipe 52 engages the upper portion of the second telescopic pipe 56 causing the second telescopic pipe 56 to be raised and, in turn, raises the second parking platform 34. As the lower end of the second telescopic pipe 56 reaches a top portion of the third telescopic rod 58, the lower end of the second telescopic pipe 56 engages the upper portion of the third telescopic rod 58 causing the third telescopic rod 58 to be raised and, in turn, raises the third parking platform 36. When all the parking platforms are raised, the parking platforms will define a maximum height h2,h3,h4 for a vehicle to enter, e.g., approximately 6 feet 8 inches.

Figure 3:
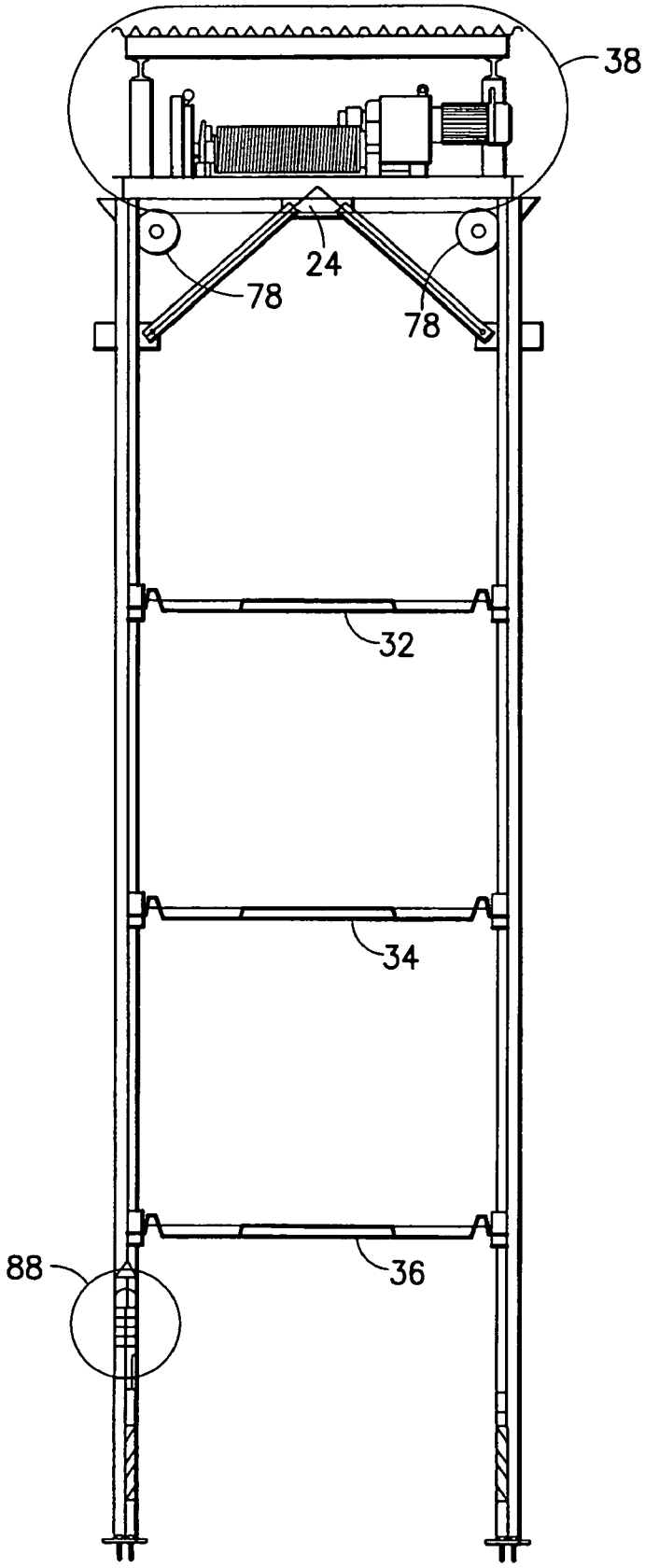
FIG. 3 is a front elevation view of a quadruple vehicle parking system in accordance with an embodiment of the present disclosure with the vehicles not present.
Figure 5:
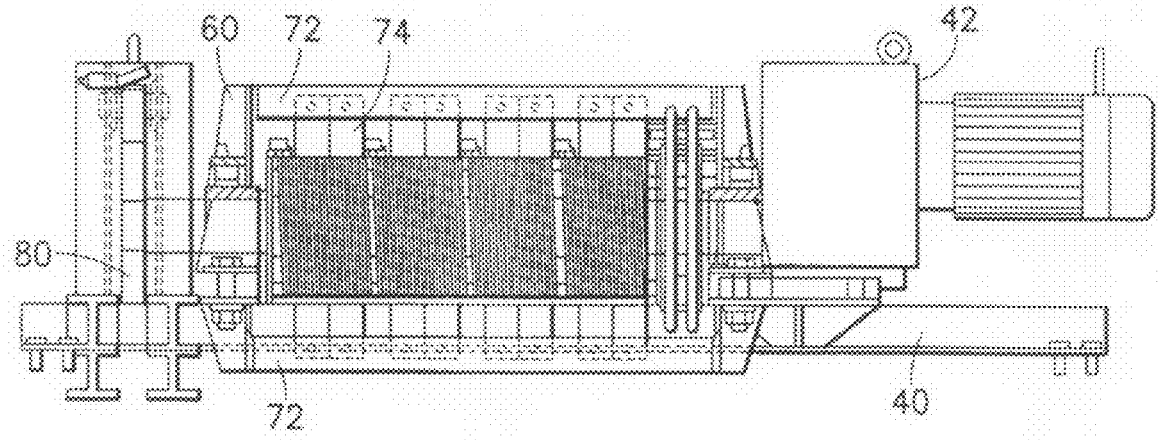
FIG. 5 is a side elevation view of a hoist unit for the quadruple vehicle parking system in accordance with an embodiment of the present disclosure.

Referring to FIGS. 5 and 6, the hoist unit 38 of the parking system 10 of the present disclosure will be described. As described above, the hoist unit is mounted on top of the rigid frame 12 via the hoist frame 40 which positions the center of gravity of the parking system within the frame 12 making the system more stable than prior art hydraulic systems where pistons and cylinders are actuated outside of the frame structure. The drum 46 is supported on the hoist frame 40 by drum stand 60 which allows the drum to rotate along its longitudinal axis. On one end of the drum is a sprocket 62 which is coupled to a complementary sprocket 64 of the drive unit 42 via chain 44. Four independent lengths of wire or cable 48 are wound around the drum 46. Each of the independent lengths of wire is coupled to a corresponding series of telescopic rods and pipes associated with each of the four posts of the rigid frame. For example, wire 50 is associated with post 14, wire 66 is associated with post 16, wire 68 is associated with post 18 and wire 70 is associated with post 20. The drum stand 60 includes two struts 72 running horizontally along the length of the drum 46 and mounted between the two struts 72 is a wire guide 74 for each of the lengths of wire 50, 66, 68, 70. The wire guides 74 will maintain the wires on a separate portion of the drum to prevent the wires from being tangled. The wires will be directed to each post via a plurality of sheaves 76, 78. The wire being unwound from the drum 46 is directed to a first sheave 76 mounted on the hoist frame 40. The wire is then directed to a second sheave 78, as best shown in FIGS. 3 and 4, which guides the wire to its corresponding series of telescopic rods and pipes.

Figure 2:
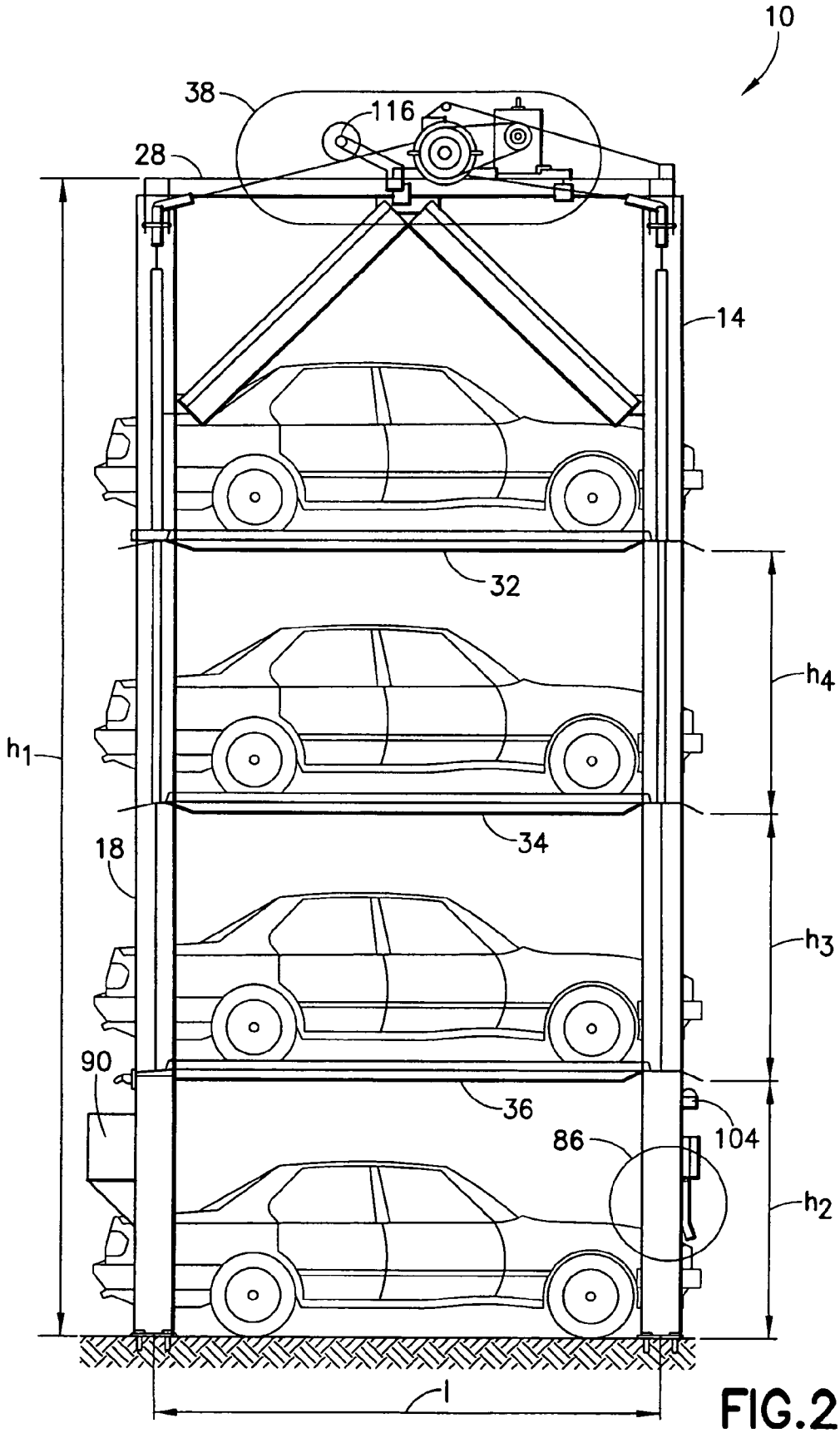
FIG. 2 is a side elevation view of the quadruple vehicle parking system shown in FIG. 1.
Figure 7:
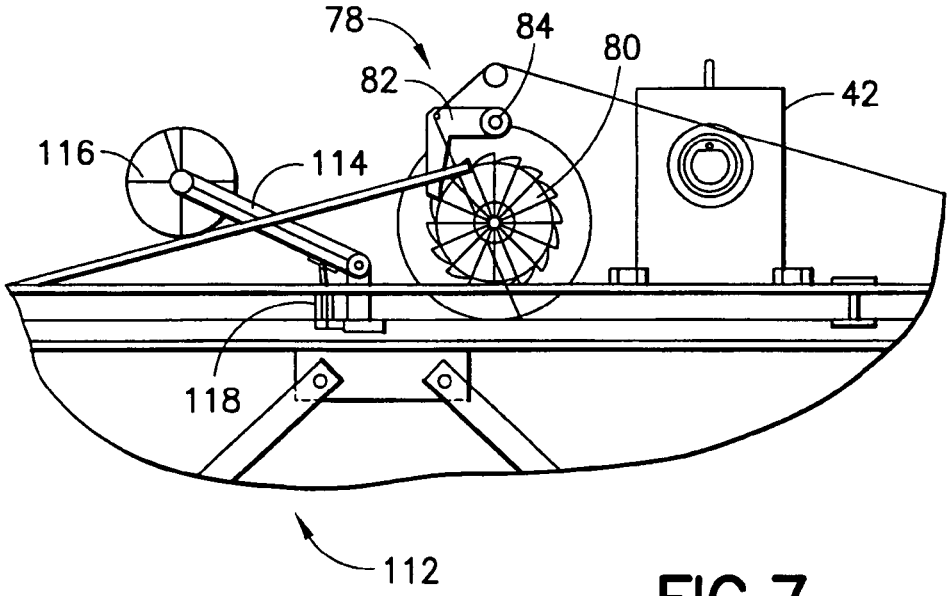
FIG. 7 is a detailed view of a portion of the safety features of the hoist unit in accordance with an embodiment of the present disclosure.

Referring to FIG. 7, a ratchet mechanism 78 is provided as a safety feature of the vehicle parking system 10. The ratchet mechanism 78 includes a ratchet wheel 80 coupled to an axle of the drum 46 and a ratchet 82 pivotably mounted to a ratchet axle 84. The ratchet 82 is coupled to and controlled by a release handle 86 which is mounted on a lower end of the rigid frame 12 as shown in FIGS. 2 and 4. The ratchet mechanism 78 will prevent the hoist unit 38 from lowering the parking platforms 32, 34, 36 without user intervention, as will be described in more detail below.

Figure 8:
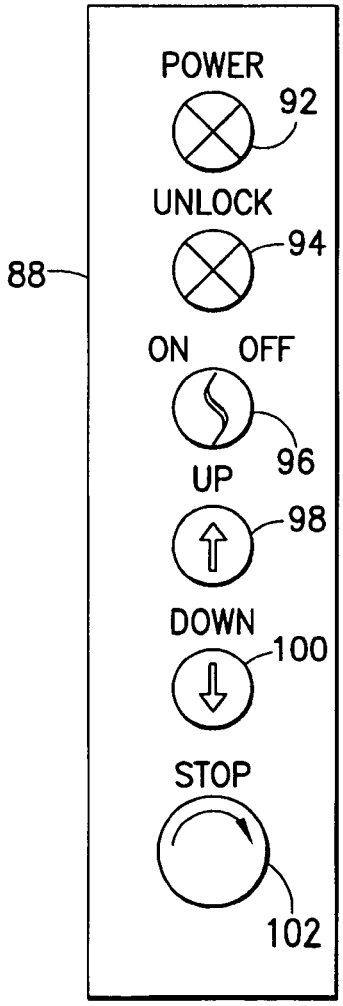
FIG. 8 is a front view of a control unit of the vehicle parking system according to an embodiment of the present disclosure.

Mounted adjacent the release handle 86 is a control unit or pushbutton station 88 which controls operation of the vehicle parking system 10. The pushbutton station 88 is coupled to the hoist unit 38 and an electrical panel box 90 which supplies power to the hoist unit 38. Referring to FIG. 8, a front face of the pushbutton station 88 is illustrated. The pushbutton station 88 includes a power indicator light 92, an unlock indicator light 94, an on/off key switch 96, an up button 98, a down button 98 and an emergency stop button 102. To activate the vehicle parking system 10, an appropriate key is inserted into the key switch 96 and turned left to the "on" position. The emergency button 102 is reset until the power indication light 92 lights up. To operate the parking system 10, a vehicle is driven onto the first parking platform 32 and the release handle 86 is pulled until the unlock indicator light 94 lights up. An operator then presses the up button 98 and the first parking platform rises and stops automatically in the first up position, i.e., high enough for a second vehicle to be driven onto the second parking platform 34. The operator may continue to press the up button 98 to raise the second platform 34 to allow a third vehicle to be driven onto the third parking platform 36. Finally, the operator will press the up button 98 again raising the third and last parking platform. When the parking platforms are raised as shown in FIGS. 1-4, the fourth vehicle to be driven into the parking system will drive onto the base 22 as opposed to a parking platform. To unload the system 10, the release handle 86 is pulled until the unlock indicator light 94 lights up. An operator will then press the down button 100 and the parking platforms will lower and stop automatically in the next down position.

The vehicle parking system may also include an operation light 104 which is illuminated or flashes whenever the system 10 is in operation, e.g., whether the parking platforms are being raised or lowered. Furthermore, the system 10 may be equipped with an audible device 106, e.g., a buzzer, siren, etc., which is activated whenever the system is in motion. The emergency stop button 102 will cause all motion to be stopped when pressed and cutoff power to the system. The system 10 will not be operational until the emergency stop button 102 is reset.

Referring to FIG. 4, the vehicle parking system 10 further includes a detector 108 for detecting if a vehicle is present on the lower most position of the frame. In one embodiment, the detector 108 includes a photoelectric sensor 110 and a corresponding reflector 112 that will sense the presence of a vehicle therebetween. If a vehicle is present in the lowest position, the down button 100 will not operate until the vehicle is removed and the detector 108 senses no vehicle present. Furthermore, the vehicle parking system 10 includes a high limit switch 200. The high limit switch 200 may be mounted on any one of the four posts 14, 16, 18, 20 and is positioned on at least one post at a maximum vertical height of the first parking platform 32. When the first parking platform 32 is raised to its highest position, the first parking platform 32 will come into contact with the high limit switch 200 which will cause the hoist unit 38 to stop elevating the parking platforms preventing a vehicle on the first parking platform 32 from coming into contact with the top of the frame 12 or the hoist frame 40 and possibly damaging the vehicle. Optionally, a redundant high limit switch may be mounted on any one of the four posts 14, 16, 18, 20 other than the post including high limit switch 200. The detector 108 or high limit switch 200 may be directly connected to the hoist unit 38 to stop motion or may be indirectly coupled to the hoist unit 38, e.g., via the control panel 90 or pushbutton station 88 which will receive a signal to stop the hoist unit 38.

Referring back to FIG. 7, the vehicle parking system also includes a bottom out mechanism 112. The mechanism 112 includes an arm 114 povitably mounted on one end to the hoist frame 40 and a slack wire sheave 116 coupled to the other end of the arm 114. Mounted below the arm 114 is a limit switch 118 which is actuated by movement of the arm 114. In operation, the sheave 116 comes into contact with a wire 50, 66, 68, 70 and, as long as there is tension on the wire, the arm 114 will not come into contact with the limit switch 118. When all of the parking platforms have been lowered to the lowest position, the wire will have some slack and allow the arm 114 to come into contact with the limit switch 118 causing the drive unit 42 to stop. In this manner, the drive unit 42 will be prevented from unwinding all of the wire on the drum 46 possibly causing the wires to be entangled.

Further economization of space can be provided by daisy-chaining a plurality of vehicle parking systems 10 of the present disclosure. In this embodiment, two posts, e.g., post 16, 20, of frame 12 can be shared by two vehicle parking systems 10 thereby obviating the need for two separate frames 12. For example, when configuring a parking system for eight vehicles only six posts will be needed; in a parking system configured for twelve vehicles only eight posts will be needed. In this manner, the vehicle parking system 10 of the present disclosure will not only save valuable physical space but will reduce material and installation costs.

A vehicle parking system has been provided including a rigid frame including four vertically upstanding posts; at least three platforms disposed in the frame, each platform being configured to support at least one vehicle; the at least three platforms being coupled to each other by a telescopic coupling, wherein in a first position the at least three platforms are nested upon each other and, upon being elevated, each platform raises the platform below each other; and a hoist unit coupled to the at least three platforms and configured to raise and lower the at least three platforms. The hoist unit employs an electric drive unit for ensuring consistent and smooth operation in various temperature conditions. Additionally, the hoist unit is mounted on top of the rigid frame positioning the center of gravity of the parking system within the frame making the system more stable than prior art hydraulic systems where pistons and cylinders are actuated outside of the frame structure.

While the disclosure has been shown and described with reference to certain preferred embodiments thereof, it will be understood by those skilled in the art that various changes in form and detail may be made therein without departing from the spirit and scope of the disclosure as defined by the appended claims.

What is claimed is:

1. A vehicle parking system comprising:

a rigid frame including four vertically upstanding posts and a base, the frame generally defining a rectangular volume;

at least three platforms movably disposed in the frame, each platform being configured to support at least one vehicle;

the at least three platforms being coupled to each other by a telescopic coupling, wherein in a first position the at least three platforms are nested upon each other and, upon being elevated, each platform raises the platform directly below;

the telescopic coupling including four telescopic members each associated with one of the four vertically upstanding posts, each telescopic member including a first pipe coupled to a first platform, a second pipe coupled to a second platform and a rod coupled to a third platform, wherein the first pipe is dimensioned to slide over the second pipe and the second pipe is dimensioned to slide over the rod; and a hoist unit centrally mounted on top of the rigid frame positioning the center of gravity of the vehicle parking system within the frame, the hoist unit including an electric drive unit coupled to the telescopic coupling and configured to raise and lower the at least three platforms, wherein upon being fully raised the at least three platforms define three parking positions, and the base defines a fourth parking position, wherein the hoist unit further comprises a single, selectively rotatable drum including four wires wound upon the drum, each of the four wires coupled to one of the telescopic members, wherein rotation of the drum will raise and lower the telescopic coupling.

2. The system as in claim 1, wherein the drum further comprises a ratchet mechanism configured to prevent unintentional lowering of the at least three platforms.

3. The system as in claim 1, further comprising a bottom out mechanism configured to determine slack in the at least one wire and prevent rotation of the drum when slack is present.

4. The system as in claim 1, further comprising at least one high limit switch positioned on at least one of the four posts at a maximum height of a highest one of the at least three platforms and configured to stop the hoist unit when the highest one of the at least three platforms make contact with the high limit switch.

5. The system as in claim 4, further comprising a redundant high limit switch disposed on at least one of the four posts other than the post including the at least one high limit switch.

6. The system as in claim 1, further comprising a detector configured for detecting if a vehicle is present on a lower most parking position of the frame.

7. The system as in claim 6, wherein the detector is further configured to stop the hoist unit upon detecting a vehicle.

* * * * *